United States Patent [19]

Sung

[11] Patent Number: 4,758,247

[45] Date of Patent: Jul. 19, 1988

[54] NOVEL SARCOSINE-POLYOL REACTION PRODUCT AND DEPOSIT-INHIBITED MOTOR FUEL COMPOSITION

[75] Inventor: Rodney L. D. Sung, Fishkill, N.Y.

[73] Assignee: Texaco Inc., White Plains, N.Y.

[21] Appl. No.: 252

[22] Filed: Jan. 2, 1987

[51] Int. Cl.[4] ..... C10L 1/18; C10L 1/22

[52] U.S. Cl. ..... 44/71; 44/62; 525/409; 528/421; 564/123

[58] Field of Search ..... 44/62, 71; 525/409; 528/421; 564/123

[56] References Cited

U.S. PATENT DOCUMENTS

| | | | |
|---|---|---|---|
| 3,647,875 | 3/1972 | Coleman | 564/123 |
| 3,684,734 | 8/1972 | Liebold et al. | 252/340 |
| 3,791,971 | 2/1974 | Lowe | 252/51.5 A |
| 4,257,780 | 3/1981 | Sung et al. | 44/63 |
| 4,301,083 | 11/1981 | Yoshimura et al. | 564/123 |
| 4,305,731 | 12/1981 | Sung et al. | 44/63 |
| 4,430,093 | 2/1984 | Jenkins, Jr. et al. | 44/70 |
| 4,445,907 | 5/1984 | Sung | 44/63 |
| 4,548,616 | 10/1985 | Sung et al. | 44/77 |
| 4,551,152 | 11/1985 | Sung | 44/53 |
| 4,561,861 | 12/1985 | Davis et al. | 44/53 |

*Primary Examiner*—Jacqueline V. Howard
*Assistant Examiner*—Jerry D. Johnson
*Attorney, Agent, or Firm*—Robert A. Kulason; Robert B. Burns; James J. O'Loughlin

[57] ABSTRACT

A novel reaction product prepared by reacting a N-acyl sarcosine compound and a polyoxyalkylene polyol containing propylene oxide-ethylene oxide block copolymer units has utility as a motor fuel additive in reducing deposit formation in and around an internal combustion engine, and consequently is useful in reducing engine ORI. The novel reaction product is of the formula:

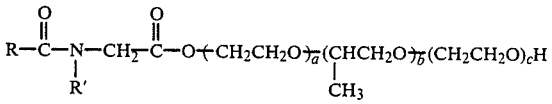

where R is a $C_8$–$C_{24}$ alkyl radical, R′ is selected from the group consisting of H, $CH_3$, or $C_2H_5$, a + c has a value ranging from 1–20, and b has a value ranging from 5–50.

14 Claims, No Drawings

NOVEL SARCOSINE-POLYOL REACTION PRODUCT AND DEPOSIT-INHIBITED MOTOR FUEL COMPOSITION

BACKGROUND OF THE INVENTION

1. Field of the Invention

This invention relates to a novel reaction product, a concentrate comprising the reaction product dissolved in a hydrocarbon solvent, and to a motor fuel composition comprising the reaction product as an additive to reduce deposit formation in and around an internal combustion engine. More particularly, this invention relates to a novel reaction product which is formed by reacting a N-acyl sarcosine compound with a polyoxyalkylene polyol containing propylene oxide and ethylene oxide moieties, a concentrate comprising the novel reaction product dissolved in a hydrocarbon solvent, and to a motor fuel composition comprising the novel reaction product.

Combustion of a hydrocarbonaceous motor fuel in an internal combustion engine generally results in the formation and accumulation of deposits on various parts of the combustion chamber as well as on the fuel intake and exhaust systems of the engine. The presence of deposits in the combustion chamber seriously reduces the operating efficiency of the engine for several reasons. First, deposit accumulation within the combustion chamber inhibits heat transfer between the chamber and the engine cooling system. This leads to higher temperatures within the combustion chamber, resulting in increases in the end gas temperature of the incoming charge. Consequently, end gas auto-ignition occurs, which causes engine knock. In addition, the accumulation of deposits within the combustion chamber reduces the volume of the combustion zone, causing a higher than design compression ratio in the engine. This, in turn, also results in serious engine knocking. A knocking engine does not effectively utilize the energy of combustion. Moreover, a prolonged period of engine knocking will cause stress fatigue and wear in vital parts of the engine. The above-described phenomenon is characteristic of gasoline powered internal combustion engines. It is usually overcome by employing a higher octane gasoline for powering the engine, and hence has become known as the engine octane requirement increase (ORI) phenomenon. It would be highly advantageous if engine ORI could be substantially reduced or eliminated by preventing deposit formation in the combustion chamber of the engine.

Another problem relates to the accumulation of deposits in the carburetor, which tend to restrict the flow of air through the carburetor at idle and at low speeds, resulting in an over-rich fuel mixture. This condition also promotes incomplete fuel combustion and leads to rough engine idling and engine stalling. Excessive hydrocarbon and carbon monoxide emissions are also produced under these conditions. It would therefore be desirable from the standpoint of engine operability and overall air quality to provide a motor fuel composition which minimizes or overcomes the above-described problems.

It is an object of this invention to provide a novel reaction product. It is another object of this invention to provide a novel motor fuel composition, characterized by its resistance to deposit formation, and consequently characterized by its ORI-inhibited properties.

2. Information Disclosure Statement

Co-assigned U.S. Pat. Nos. 4,561,861 (David et al.) and 4,548,616 (Sung et al.) disclose motor fuel compositions comprising a polyol compound having a propylene oxide-ethylene oxide backbone, the polyol having the formula:

$$OH(CH_2CH_2O)_a-(\underset{\underset{CH_3}{|}}{CH}-CH_2O)_b-(CH_2CH_2O)_cH$$

where a+c is an integer in the range of about 8.0–16.0, and b is an integer in the range of about 12–22.

Co-assigned U.S. Pat. No. 4,551,152 (Sung) discloses a wear-inhibiting additive for motor fuel compositions which is obtained by reacting a polyol with a carboxy phenol to form an ester, and thereafter reacting the ester with an aldehyde or ketone and an N-alkyl-alkylene diamine.

Co-assigned U.S. Pat. No. 4,445,907 discloses a corrosion inhibitor useful in alcohol compositions, where the corrosion inhibitor is the amide reaction product of a carboxylic acid and an aminotetrazole, and is of the formula:

$$R-\overset{\overset{O}{\|}}{C}-\underset{\underset{R'''}{|}}{N}-R'-\overset{\overset{O}{\|}}{C}-[NHR'']$$

wherein R is a $C_{10}$–$C_{20}$ alkyl, alkenyl, alkaryl, aralkyl, aryl, or cycloalkyl hydrocarbon group, R′ is a divalent hydrocarbon group selected from the same group as R and having one less hydrogen, R‴ is alkyl, aryl, alkaryl, or aralkyl, and NH—R′ is an aminotetrazole group.

Co-assigned U.S. Pat. No. 4,430,093 (Jenkins et al.) discloses a diesel fuel additive which is the reaction product of a polyol compound having a propylene oxide-ethylene oxide backbone (such as those polyols disclosed in U.S. Pat. Nos. 4,561,861, 4,551,152, 4,548,616 and the instant invention) and a benzophenone tetracarboxylic dianhydride.

Co-assigned U.S. Pat. No. 4,305,731 (Sung et al.) discloses a novel detergent and corrosion-inhibiting motor fuel additive which is prepared by reacting an N-acyl sarcosine compound and a polyalkylene polyamine compound to form an aminoalkylimidazoline derivative.

Co-assigned U.S. Pat. No. 4,257,780 (Sung et al.) discloses motor fuel compositions comprising novel oxazolonium hydroxide compounds of the formula:

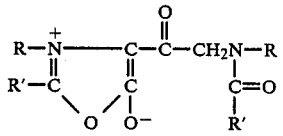

wherein R is a hydrocarbyl radical having from 1 to 5 carbon atoms and R′ is a hydrocarbyl radical having from 10 to 20 carbon atoms.

U.S. Pat. No. 3,791,971 (Lowe) discloses a lubricating oil composition comprising an additive which may be a polyol compound (such as those polyols disclosed in U.S. Pat. Nos. 4,561,861, 4,551,152, 4,548,616, and the instant invention) or a reaction product of a polyol compound and mono or polyisocyanates, mono or dicarboxylic acids, or acid halides and anhydrides.

U.S. Pat. No. 3,684,734 (Liebold et al.) discloses the use of the esterification product of (i) a polyoxyethylene-polyoxypropylene block copolymer and (ii) an aliphatic or aromatic hydroxy carboxylic acid as a demulsifier for crude oil emulsions.

API Primary Petroleum Products Abstract No. 73-20769 (June 18, 1973) describes German Pat. No. DE 2148609, which discloses an anti-icing and corrosion inhibiting motor fuel additive which is the combination of: (i) a polyalkylene glycol; (ii) a monohydric alcohol; (iii) an acid amide; (iv) a glycol ether; and (v) an N-acyl sarcosine salt with 2–16 carbon aliphatic or cycloaliphatic amines.

SUMMARY OF THE INVENTION

It has been found that a novel reaction product which is prepared by reacting a N-acyl sarcosine compound and a plyoxyalkylene polyol containing propylene oxide and ethylene oxide moieties is useful as an additive in motor fuel compositions to inhibit deposit formation and accumulation, and consequently useful as an ORI-inhibitor in motor fuel compositions. The reaction product of the instant invention is of the formula:

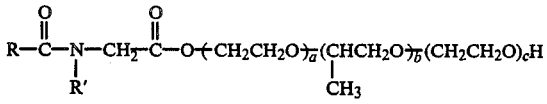

where R is a $C_8$–$C_{24}$, preferably a $C_{12}$–$C_{20}$ alkyl radical, more preferably an alkyl radical selected from the group consisting of oleyl, coco, lauryl, stearyl, and tallow, most preferably oleyl, R′ is H, $CH_3$, or $C_2H_5$, most preferably $CH_3$, a+c has a value ranging from 1–20, preferably 2–5, most preferably 2.2, and b has a value ranging from 5–50, preferably 10–20, most preferably 14.7.

The instant invention is also directed to a concentrate composition comprising a total of 1.0–75.0 weight percent, preferably 5.0–35.0 weight percent of the above-described reaction product dissolved in a suitable hydrocarbon solvent, the concentrate being employed as a motor fuel additive to produce the deposit- and ORI-inhibited motor fuel composition of the instant invention. Motor fuel compositions comprise 0.0005–0.5, preferably 0.001–0.1, most preferably 0.01–0.05 weight percent of the reaction product of the instant invention.

DETAILED EMBODIMENTS OF THE INVENTION

The novel reaction product of the instant invention is prepared by reacting a N-acyl sarcosine compound with a polyoxyalkylene polyol containing propylene oxide and ethylene oxide moieties. The N-acyl sarcosine reactant is of the formula:

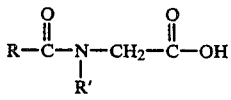

where R is a $C_8$–$C_{24}$, preferably a $C_{12}$–$C_{20}$ alkyl radical, more preferably an alkyl radical selected from the group consisting of oleyl, coco, lauryl, stearyl, and tallow, most preferably oleyl, and R′ is H, $CH_3$, or $C_2H_5$, most preferably $CH_3$.

Examples of N-acyl sarcosine reactants suitable for use are those sold under the SARKOSYL trademark by the Ciba-Geigy Company, and they include SARKOSYL-O (oleoyl sarcosine) having a molecular weight in the range of about 345–360, SARKOSYL-L (lauroyl sarcosine), having a molecular weight in the range of about 270–285, SARKOSYL-LC (cocoyl sarcosine), having a molecular weight in the range of about 285–300, SARKOSYL-S (stearoyl sarcosine), having a molecular weight in the range of about 330–345, and SARKOSYL-T (tallow sarcosine), having a molecular weight in the range of about 360–370. Oleoyl sarcosine is particularly preferred for use as the N-acyl sarcosine reactant to prepare the novel reaction product of the instant invention.

The polyoxyalkylene polyol reactant is preferably a polyol containing a block copolymer of propylene oxide and ethylene oxide moieties, the polyol having a molecular weight $M_n$ in the range of about 500–5000, preferably about 750–3500, most preferably about 900–2000. The polyoxyalkylene polyol reactant is of the formula:

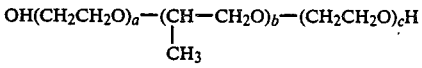

where a+c has a value ranging from 1–20, preferably 2–5, most preferably 2.2, and b has a value ranging from 5–50, preferably 10–20, most preferably 14.7.

Polyoxyalkylene polyol reactants suitable for use in preparing the novel reaction product of the instant invention include polyols such as those commercially available from the BASF Wyandotte Corporation under the PLURONIC series tradename. Examples of such polyols include those in Table I below, the first-listed polyol being particularly preferred.

TABLE I

A. The BASF Wyandotte Pluronic L-31 brand of poly (oxyethylene) poly (oxypropylene) poly (oxyethylene) polyol having a molecular weight $M_n$ of 950 and containing 10 wt. % derived from poly (oxyethylene) and 90 wt. % derived from poly (oxypropylene). In this polyol, b is 14.7 and a+c is 2.2.

B. The BASF Wyandotte Pluronic L-63 brand of poly (oxyethylene) poly (oxypropylene) poly (oxyethylene) polyol having a molecular weight $M_n$ of 1750 and containing 30 wt. % drived from poly (oxyethylene) and 70 wt. % derived from poly (oxypropylene). In this polyol, b is 21.1 and a+c is 11.9.

C. The BASF Wyandotte Pluronic L-62 brand of poly (oxyethylene) poly (oxypropylene) poly (oxyethylene) polyol having a molecule weight $M_n$ of 1750 and containing 20 wt. % derived from poly (oxyethylene) and 80 wt. % derived from poly (oxypropylene). In this polyol, b is 24.1 and a+c is 8.

D. The BASF Wyandotte Pluronic L-43 brand of poly (oxyethylene) poly (oxypropylene) poly (oxyethylene) polyol having a molecule weight $M_n$ 1200 and containing 30 wt. % drived from poly (oxyethylene) and 70 wt. % derived from poly (oxypropylene). In this polyol, b is 16.6 and a+c is 5.5.

E. The BASF Wyandotte Pluronic L-64 brand of poly (oxyethylene) poly (oxypropylene) poly (oxyethylene) polyol having a molecule weight $M_n$ 1750 and containing 40 wt. % derived from poly (oxyethylene) and 60 wt. % derived from poly (oxypropylene). In this polyol, b is 18.1 and a+c is 15.9.

The novel reaction product compound of the instant invention is prepared by reacting about 1–2 moles, preferably 1 mole of the N-acyl sarcosine reactant with about 1–2 moles, preferably 1 mole of the polyoxyalkylene polyol reactant. The reaction is preferably carried out at a temperature range of 100°–200° C., preferably 120° C. in the presence of a solvent. A preferred solvent is one which will distill with water azeotropically. Suitable solvents include hydrocarbons boiling in the gasoline boiling range of about 30° C. to about 200° C. Generally this will include saturated and unsaturated hydrocarbons having from about 5 to about 10 carbon atoms. Specific suitable hydrocarbon solvents include hexane, cyclohexane, benzene, toluene, and mixtures thereof. Xylene is the preferred solvent. The solvent can be present in an amount of up to about 90 percent by weight of the total reaction mixture. In addition, the reaction is carried out in the presence of an alkyl sulfonic acid catalyst, preferably benzosulfonic acid or toluenesulfonic acid, with o-toluenesulfonic acid and p-toluenesulfonic acid being particularly preferred.

In the best mode for preparing the novel reaction product compound of the instant invention, about 1 mole of N-acyl sarcosine reactant and about 1 mole of polyoxyalkylene polyol reactant are combined with the solvent xylene and a minor amount of the catalyst toluene sulfonic acid. This mixture is reacted at the reflux temperature of the solvent and azeotroped until no more water can be removed from the reaction mixture. The novel reaction product compound can then be separated from the solvent using conventional means, or left in admixture with some or all of the solvent to facilitate addition of the reaction product to gasoline or another motor fuel composition.

The novel reaction product compound of the instant invention is of the formula:

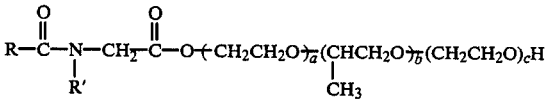

where R is a $C_8$–$C_{24}$, preferably a $C_{12}$–$C_{20}$ alkyl radical, more preferably an alkyl radical selected from the group consisting of oleyl, coco, lauryl, stearyl, and tallow, most preferably oleyl, R′ is H, $CH_3$, or $C_2H_5$, preferably $CH_3$, a+c has a value ranging from 1–20, preferably 2–5, most preferably 2.2, and b has a value ranging from 5–50, preferably 10–20, most preferably 14.7.

The following examples illustrate the preferred method of preparing the novel reaction product compound of the instant invention. It will be understood that the following examples are merly illustrative, and are not meant to limit the invention in any way. In the examples, all parts are parts by weight unless otherwise specified.

EXAMPLE 1

A novel reaction product compound was prepared by reacting about 180 parts of oleoyl sarcosine (SARKOSYL-O), 783 parts of a polyoxyalkylene polyol containing a propylene oxide-ethylene oxide block copolymer and having a molecular weight of about 950 (PLURONIC L-31), in 500 parts of xylene and 2 parts of o-toluene sulfonic acid. The mixture was reacted at the reflux temperature of xylene and azeotroped until no more water could be removed. The reaction product was then filtered and stripped of remaining solvent under a vacuum to yield the novel compound of the formula:

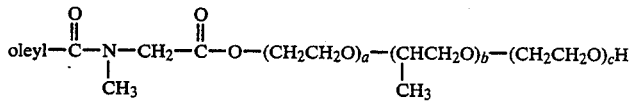

where a+c has a value of about 2.2, and b has a value of 14.7.

EXAMPLE 2

A novel reaction product compound is prepared by reacting about 137.5 parts of lauroyl sarcosine (SARKOSYL-L), 783 parts of a polyoxyalkylene polyol containing a propylene oxide-ethylene oxide block copolymer and having a molecular weight of about 950 (PLURONIC L-31), in 500 parts of xylene and 2 parts of p-toluene sulfonic acid. The mixture is reacted at the reflux temperature or xylene and azeotroped until no more water can be removed. The reaction product is then filtered and stripped of remaining solvent under a vacuum to yield the novel compound of the formula:

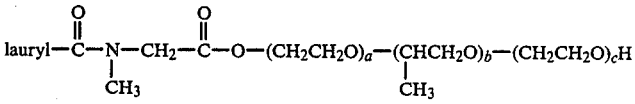

where a+c has a value of about 2.2, and b has a value of 14.7.

EXAMPLE 3

A novel reaction product compound is prepared by reacting about 145 parts of cocoyl sarcosine (SARKOSYL-LC), 783 parts of a polyoxyalkylene polyol containing a propylene oxide-ethylene oxide block copolymer and having a molecular weight of about 950 (PLURONIC L-31), in 500 parts of xylene and 2 parts of p-toluene sulfonic acid. The mixture is reacted at the reflux temperature of xylene and azeotroped until no more water can be removed. The reaction product is then filtered and stripped of remaining solvent under a vacuum to yield the novel ester compound of the formula:

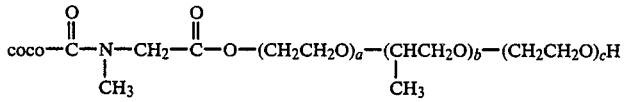

where a+c has a value of about 2.2, and b has a value of 14.7.

EXAMPLE 4

A novel reaction product compound is prepared by reacting about 169 parts of stearoyl sarcosine (SARKOSYL-S), 783 parts of a polyoxyalkylene polyol containing a propylene oxide-ethylene oxide block copolymer and having a molecular weight of about 950 (PLURONIC L31), in 500 parts of xylene and 2 parts of p-toluene sulfonic acid. The mixture is reacted at the reflux temperature of xylene and azeotroped until no more water can be removed. The reaction product is then filtered and stripped of remaining solvent under a vacuum to yield the novel compound of the formula:

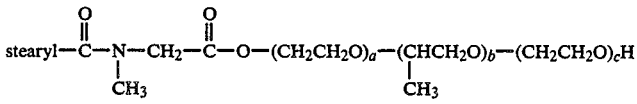

where a+c has a value of about 2.2, and b has a value of 14.7.

It has been found that a motor fuel composition comprising 0.0005–0.5 weight percent, preferably 0.001–0.1 weight percent, most preferably 0.01–0.05 weight percent of the novel reaction product compound of the instant invention is effective in minimizing and reducing gasoline internal combustion engine deposits. This is an improvement in the fuel performance which may reduce the incidence of engine knock. A motor fuel composition of the instant invention was tested by the Combustion Chamber Deposit Screening Test (CCDST). In this test, the deposit-forming tendencies of a gasoline are measured. The amount of deposit formation correlates well with the ORI performance observed in car tests and engine tests. The amount of deposit is compared to a high reference (a standard gasoline known to have a high deposit formation) and a low reference (an unleaded base fuel which is known to have a low deposit formation).

The CCDST determines whether the additive in question is effective as a deposit control additive to prevent ORI. In this test, the additive sample of the novel reaction product compound of Example 1 was dissolved in an unleaded base fuel (hereinafter designated as Base Fuel A) in a concentration of 100 PTB (100 pounds of additive per 1000 barrels of fuel, equivalent to about 0.033 weight percent of additive). Base Fuel A is a regular grade essentially unleaded gasoline (less than 0.05 grams of tetraethyl lead per gallon), and comprises a mixture of hydrocarbons boiling in the gasoline boiling range, consisting of about 22% aromatic hydrocarbons, 11% olefinic carbons, and 6 or 7% paraffinic hydrocarbons, boiling in the range from about 90° F. to 450° F.

In a nitrogen/hot air environment the gasoline was then atomized and sprayed onto a heated aluminum tube. After 100 minutes, the deposits which were formed on the tube were weighed. Gasolines which form larger amounts of deposits on the heated aluminum tube cause the greatest ORI when employed in an internal combustion engine. The CCDST was also employed to measure the deposit tendencies of a high reference fuel (Example H), known to yield a large deposit, and a low reference fuel (Example L), a standard unleaded gasoline known to yield a low deposit. The results are summarized in Table II below:

TABLE II

| Example | CCDST result (mg) |
|---|---|
| Instant Invention (Base Fuel A + 100 PTB Example 1) | 6.8 |
| L (low reference) | 5.9 |
| H (high reference) | 13.1 |

The above results illustrate that motor fuel compositions of the instant invention are approximately equivalent to the low reference unleaded base fuel, and greatly superior to the high reference standard fuel, in terms of resistance to deposit formation, and consequently in terms of ORI-inhibition.

Preferred motor fuel compositions for use with the novel reaction product compound as set forth by the instant invention are those intended for use in spark ignition internal combustion engines. Such motor fuel compositions, generally referred to as gasoline base stocks, preferably comprise a mixture of hydrocarbons boiling in the gasoline boiling range, preferably from about 90° F. to about 450° F. This base fuel may consist of straight chains or branch chains or paraffins, cycloparaffins, olefins, aromatic hydrocarbons, or mixtures thereof. The base fuel can be derived from, among others straight run naphtha, polymer gasoline, natural gasoline, or from catalytically cracked or thermally cracked hydrocarbons and catalytically reformed stock. The composition and octane level of the base fuel are not critical and any conventional motor fuel base can be employed in the practice of this invention. In addition, the motor fuel composition may contain any of the additives generally employed in gasoline. Thus, the motor fuel composition can contain anti-knock compounds such as tetraethyl lead compounds, anti-icing additives, upper cylinder lubricating oils, and the like.

For convenience and economy in shipping and handling it is conventioanl to prepare concentrates of the novel reaction product compound of the instant invention for use as additives in motor fuel compositions. The novel reaction product compound of the instant invention may be prepared as a concentrate in a suitable liquid hydrocarbon solvent. Such a concentrate may contain from about 1.0 to 75.0 wt. % of the novel compound dissolved in the hydrocarbon solvent, with the preferred concentration being from about 5.0 to about 35.0 wt. %. Suitable hydrocarbon solvents for use in the above-described concentrate include toluene and xylene; xylene is the preferred hydrocarbon solvent for use.

It will be evident that the terms and expressions employed herein are used as terms of description and not of limitation. There is no intention, in the use of these descriptive terms and expressions, of excluding equivalents of the features described and it is recognized that various modifications are possible within the scope of the invention claimed.

The invention claimed is:

1. Compounds of the formula:

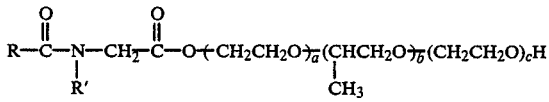

where R is a $C_8$–$C_{24}$ alkyl radical, R′ is selected from the group consisting of H, $CH_3$, or $C_2H_5$, a+c has a value ranging from 1–20, and b has a value ranging form 5–50.

2. Compounds according to claim 1, where R is a $C_{12}$–$C_{20}$ alkyl radical, R′ is $CH_3$, a+c has a value ranging from 2–5, and b has a value ranging from 10–20.

3. Compounds according to claim 1, where R is an alkyl radical selected from the group consisting of oleyl, coco, lauryl, tallow, and stearyl.

4. Compounds of the formula:

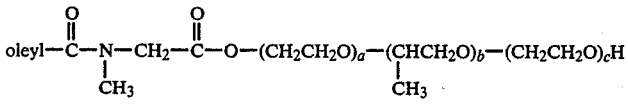

where a+c has a value of about 2.2, and b has a value of about 14.7.

5. A concentrate composition comprising 1.0–75.0 weight percent of any of the compounds of claims 1–4 in admixture with a hydrocarbon solvent.

6. A concentrate composition comprising 5.0–35.0 weight percent of any of the compounds of claims 1–4 in admixture with a hydrocarbon solvent.

7. A motor fuel composition comprising a mixture of hydrocarbons boiling in the range from about 90° F.–450°. F. and additionally comprising from about 0.0005–0.5 weight percent of an additive compound of the formula:

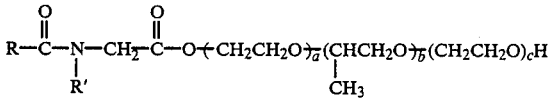

where R is a $C_8$–$C_{24}$ alkyl radical, R′ is selected from the group consisting of H, $CH_3$, or $C_2H_5$, a+c has a value ranging from 1–20, and b has a value ranging from 5–50.

8. A motor fuel composition according to claim 7, where R is a $C_{12}$–$C_{20}$ alkyl radical, R′ is $CH_3$, a+c has a value ranging from 2–5, and b has a value ranging from 10–20.

9. A motor fuel composition according to claim 7, where R is an alkyl radical selected from the group consisting of oleyl, coco, lauryl, tallow, and stearyl.

10. A motor fuel composition as in any of claims 7–9 comprising from about 0.001–0.1 weight percent of said additive compound.

11. A motor fuel composition as in any of claims 7–9 comprising from about 0.01–0.05 weight percent of said additive compound.

12. A motor fuel composition comprising a mixture of hydrocarbons in the range from about 90° F.–450° F. and additionally comprising from about 0.0005–0.5 weight percent of an additive compound of the formula:

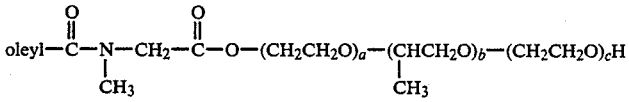

where a+c has a value of about 2.2, and b has a value of about 14.7.

13. A motor fuel composition according to claim 12, comprising from about 0.001–0.1 weight percent of said additive compound.

14. A motor fuel composition according to claim 13, comprising from about 0.01–0.005 weight percent of said additive compound.

* * * * *

UNITED STATES PATENT AND TRADEMARK OFFICE

CERTIFICATE OF CORRECTION

PATENT NO. : 4,758,247

DATED : July 19, 1988

INVENTOR(S) : R. L. D. SUNG

It is certified that error appears in the above—identified patent and that said Letters Patent is hereby corrected as shown below:

Claim 1, Column 9, line 20, change "form" to --from--.
Claim 14, Column 10, line 50, change "0.005" to --0.05--.

Signed and Sealed this

Twenty-ninth Day of November, 1988

*Attest:*

DONALD J. QUIGG

*Attesting Officer*

*Commissioner of Patents and Trademarks*